US005142114A

United States Patent [19]

Briggs et al.

[11] Patent Number: 5,142,114

[45] Date of Patent: Aug. 25, 1992

[54] MICROWAVE CHAMBER FOR HEATING FOODSTUFFS

[76] Inventors: David H. Briggs, Manor House Farm, Silchester, Nr Reading RG7 2HL; Richard F. Freeman, 13 High Street, Linton, Cambridge CB1 6HS, both of Great Britain

[21] Appl. No.: 671,828

[22] PCT Filed: Sep. 28, 1989

[86] PCT No.: PCT/GB89/01152

§ 371 Date: May 22, 1991

§ 102(e) Date: May 22, 1991

[87] PCT Pub. No.: WO90/03718

PCT Pub. Date: Apr. 5, 1990

[30] Foreign Application Priority Data

Sep. 28, 1988 [GB] United Kingdom ..... 8822706

[51] Int. Cl.[5] ..... H05B 6/80

[52] U.S. Cl. ..... 219/10.55 F; 219/10.55 E

[58] Field of Search ..... 219/10.55 F, 10.55 E, 219/10.55 A, 10.55 R

[56] References Cited

U.S. PATENT DOCUMENTS

| | | | |
|---|---|---|---|
| 2,956,144 | 10/1960 | Woodman | 219/10.55 R |
| 2,993,973 | 7/1961 | Johnson et al. | 219/10.55 R |
| 3,281,727 | 10/1966 | Niebuhr et al. | 219/10.55 R |
| 3,440,383 | 4/1969 | Smith | 219/10.55 R |
| 3,783,220 | 1/1974 | Tanizaki | 219/10.55 E |
| 4,803,324 | 2/1989 | Fujii et al. | 219/10.55 F |

FOREIGN PATENT DOCUMENTS

| | | |
|---|---|---|
| 1049019 | 1/1959 | Fed. Rep. of Germany . |
| 1161350 | 8/1969 | United Kingdom . |

*Primary Examiner*—Philip H. Leung
*Attorney, Agent, or Firm*—Lee, Mann, Smith McWilliams, Sweeney & Ohlson

[57] ABSTRACT

A microwave chamber for heating pre-cooked foodstuff (10) including a magnetron (14) feeding radiation via a waveguide (16). The microwave is reflected off the inside of a domed lid (18) and focussed onto the foodstuff. A deflector element may be movable in the waveguide to thereby change the pattern of microwave radiation projected onto the foodstuff.

3 Claims, 1 Drawing Sheet

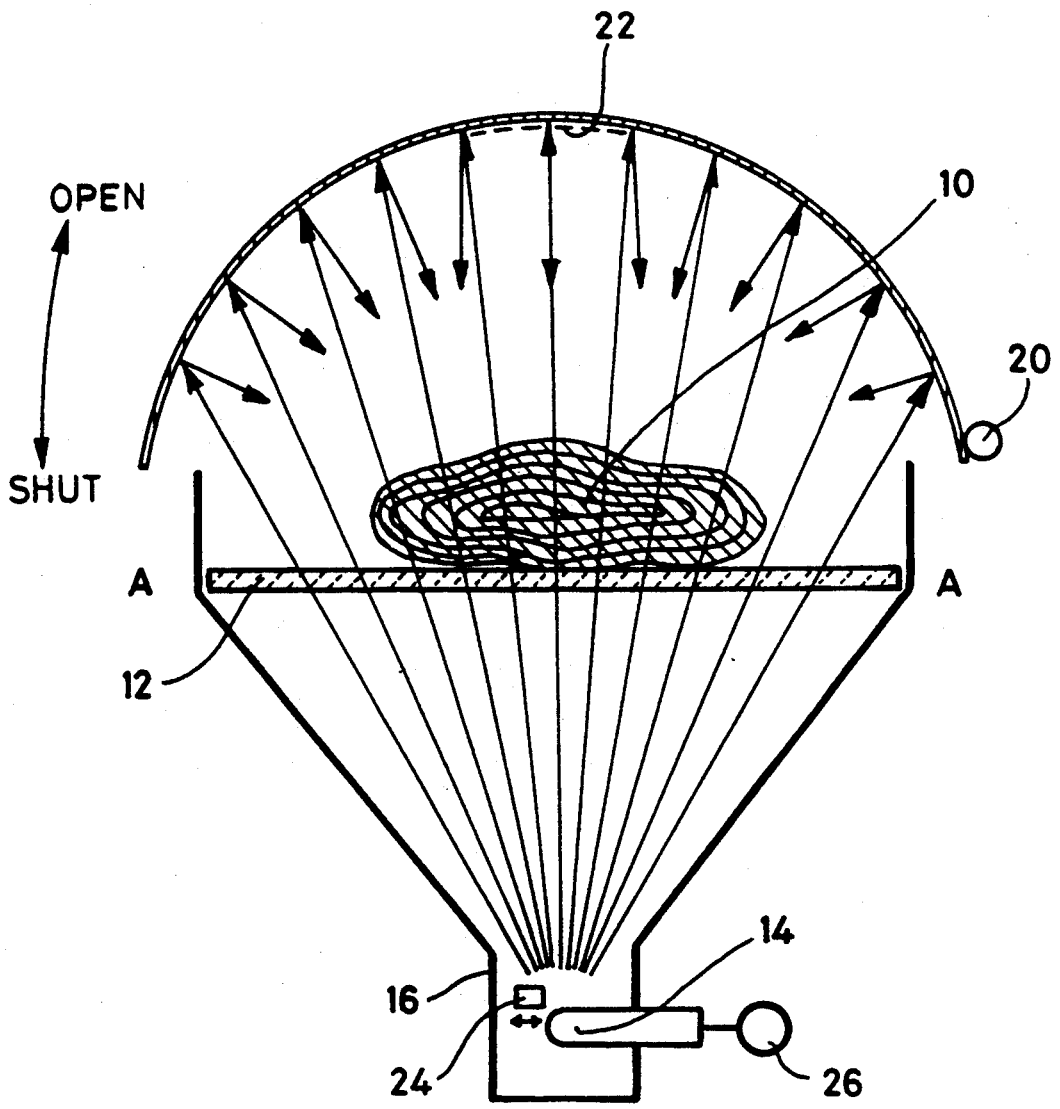
22
OPEN
10
20
SHUT
A
A
12
14
16
24
26

MICROWAVE CHAMBER FOR HEATING FOODSTUFFS

FIELD OF THE INVENTION

This invention concerns chambers for heating foodstuffs, particularly pre-cooked frozen food, using microwave energy.

BACKGROUND TO THE INVENTION

There is an increasing demand for fast food typically at railway stations, airports and garages. One of the more convenient ways of storing such pre-cooked foodstuffs is by deep freezing them after cooking; it is then only necessary to re-heat the foodstuff as quickly as possible to provide a hot meal or snack.

Microwave energy is most conveniently used for such reheating and it is an object of the present invention to provide an improved form of heating chamber particularly adapted to the re-heating of pre-cooked foodstuffs.

SUMMARY OF THE INVENTION

According to the present invention a chamber for heating foodstuffs, which includes a source of microwave energy for projecting microwave energy into the chamber, also includes a microwave reflecting and focussing surface formed on the inside surface of a closure member which can be opened to give access to the chamber, and which is located opposite the microwave inlet, to reflect and focus microwave energy incident thereon; a support for the foodstuff located within the chamber on which foodstuff can be located at or near the focal point of the reflecting surface; a wave guide for feeding microwave energy radiation from the source; and means provided within the wave guide to alter the direction in which the radiation emanates therefrom or to alter the virtual point from which the radiation appears to come so as to alter the position of the point in the chamber at which the radiation is generally brought to a focus or concentrated.

By moving the inserted element in the wave guide, so the position of focus or concentration of the E-field shape and intensities can be varied so as to produce more uniform heating of the foodstuff.

Where the foodstuff and platform are located between the microwave inlet and the closure member, the foodstuff support is preferably formed from material which is substantially transparent to microwave radiation so that the latter can pass through the support.

The foodstuff will be, to a greater or lesser extent, also transparent to microwave energy and consequently radiation emanating from the inlet in alignment with the foodstuff will partially heat the foodstuff and partially pass therethrough to be reflected from the reflecting surface and once again intercept the foodstuff and add to the heating thereof.

In conventional manner, means may be provided to time the period during which microwave energy is supplied to the chamber.

Where a browning-aid is located within the chamber, the adjustment of the focusing of the microwave energy may be used to divert some or all of the microwave energy from the foodstuff to the browning aid to thereby cause the latter to become heated to produce infra red radiation in place of or in addition to the microwave radiation, for browning the foodstuff whilst it is being heated by microwave energy.

BRIEF DESCRIPTION OF THE DRAWING

The invention will now be described by way of example with reference to the accompanying drawing in which the single Figure is a schematic cross-section through a food heating chamber constructed as one embodiment of the invention.

DETAILED DESCRIPTION OF THE PREFERRED EMBODIMENT

The drawing shows a microwave heating chamber for heating pre-cooked foodstuffs of which an example is shown at 10. The latter is carried by a support plate of ceramic material 12 so as to be transparent to the microwave energy which emanates from a magnetron 14 which is located at the lower end of a conical wave guide 16 the upper end of which includes the circular plate 12 on which the foodstuff is located.

Above the plate 12 is located a hemispherical dome shaped lid 18 formed from, or at least coated, or covered on its inside surface, with a material which is highly reflective of microwave energy, so that radiation emanating from the magnetron 14 and reaching the reflecting surface of the lid 18 will be reflected back towards the foodstuff 10.

The distance of the reflecting surface of the lid 18 from the foodstuff 10 and the radius of the hemispherical surface is selected so that in general any radiation incident on the concave surface of the hemisphere will be directed towards the central region of the plate 12 and thereby towards the foodstuff located thereon.

A browning-aid is located within the chamber in the form of a plate 22 which is an absorber of microwave energy to convert the latter into infra red radiation to irradiate the foodstuff and cause the surface to become brown. Movement of a deflector or tuning device 24 into and out of the path of the radiant microwave energy in the wave guide 16 can cause a change in the pattern of the energy incident on the reflecting surface 18 to thereby divert some or all of the radiant energy away from the foodstuff and onto the plate 22 when required. The period during which microwave energy is supplied to the chamber is controlled by the timer 26.

The hemispherical lid is hinged at 20 so as to be capable of being lifted to reveal the interior of the chamber to allow foodstuff to be inserted or removed.

We claim:

1. A microwave heating device comprising: a chamber for heating foodstuffs; a source for projecting microwave radiation into the chamber from a microwave inlet; a microwave reflecting and focussing surface formed on the inside surface of a closure member which is openable to give access to the chamber, said surface being located opposite said microwave inlet to reflect and focus microwave radiation incident thereon; a support within the chamber on which foodstuff can be located at the focal point of the reflecting surface; a waveguide for feeding microwave radiation from said source to said inlet; an element within the waveguide to alter the direction in which the radiation emanates therefrom so as to alter the position of the point in the chamber at which the radiation is generally brought to a focus; and a browning aid located within the chamber, the adjustment of said element for being used to divert some microwave radiation from the foodstuff to the browning aid to thereby cause the latter to become heated to produce infra red radiation for browning the foodstuff whilst it is also being heated by microwave radiation.

2. A device according to claim 1, in which the support for the foodstuff is formed from material which is substantially transparent to microwave radiation so that the latter can pass through the support.

3. A device according to claim 1, further comprising means to time the period during which microwave energy is supplied to the chamber.

* * * * *